United States Patent [19]

Domnitch

[11] Patent Number: 4,688,494

[45] Date of Patent: Aug. 25, 1987

[54] INCINERATOR TOWABLE BY A VEHICLE FOR BURNING REFUSE

[76] Inventor: Irving Domnitch, 80-15 Forty-First Ave., Elmhurst, N.Y. 11373

[21] Appl. No.: 886,384

[22] Filed: Jul. 17, 1986

[51] Int. Cl.[4] ..... F23D 3/00

[52] U.S. Cl. ..... 110/240; 110/241; 126/276

[58] Field of Search ..... 110/240, 241, 235; 126/276

[56] References Cited

U.S. PATENT DOCUMENTS

| | | | |
|---|---|---|---|
| 2,882,842 | 4/1959 | Royer | 110/240 |
| 3,307,507 | 3/1967 | Boyd et al. | 110/240 X |
| 3,682,115 | 8/1972 | Rodgers | 110/240 X |
| 3,939,783 | 2/1976 | du Chambon | 110/240 |

*Primary Examiner*—Edward G. Favors

*Attorney, Agent, or Firm*—Ostrolenk, Faber, Gerb & Soffen

[57] ABSTRACT

A self-contained incinerator on wheels is designed to be towed by a vehicle such as a small truck from location to location in order to handle the garbage disposal needs of each location. The refuse can be burned in place or while the incinerator is in transit between locations. A generally rectangular incinerator housing supported on a frame mounted on wheels contains a rear section with a main firing chamber which can be loaded with refuse and a secondary reduction chamber located along the front of the housing which includes an after burner for burning the fumes that issue from the main firing chamber and a wet-scrubbing apparatus for removing particulate and other harmful material from the emissions that enter into the atmosphere. Wire mesh disposed on the outer walls of the incinerator and an interior wall construction that expands and contracts with temperature changes in the incinerator respectively prevent accidental scalding of curious onlookers and buckling or warping of the incinerator's outer walls.

15 Claims, 5 Drawing Figures

10
38
44
50
48
40
98
GAS
72
14
96
WATER
15
13
24
22
28
36
11
60
62
56
26
18
16
68

INCINERATOR TOWABLE BY A VEHICLE FOR BURNING REFUSE

BACKGROUND OF THE INVENTION

This invention relates to an incinerator, and more particularly, to an incinerator which can be towed by a vehicle from site to site in order to meet the refuse disposal needs at various dispersed locations.

A portable self-containing incinerator apparatus is described in U.S. Pat. No. 3,728,976 issued Apr. 24, 1973 in the name of Irving Domnitch, the Applicant herein. The subject matter of the foregoing patent is incorporated herein by reference. The portable incinerator of the U.S. Pat. No. 3,728,976 comes in a rectangularly shaped housing which includes a main firing chamber, an after burner chamber for secondary burning of emissions that emanate from the main firing chamber, a wet-scrubbing section for removing particulate and other harmful materials from the emissions and a smoke stack. All the foregoing components are arranged vertically one above the other. A pair of casters or rollers disposed along one side of the housing permits the housing to be tilted from the vertical and to be transported-hand truck like-from one location to another. Ordinarily, however, the housing is supported on leveling chucks which engage threaded apertures formed in several suitably located mounting brackets disposed on the bottom of the incinerator housing.

Although the self-contained incinerator of the above patent provides a useful alternative for waste disposal, experience has shown that its universal usefulness is burdened with several shortcomings. For example, the vertical orientation of its components makes it too high and not particularly adaptable for pratical towing by a vehicle over common roads. Since it is tilted while being moved about, burning of refuse during travel is impossible. Moreover the exposed outer surfaces of the prior art device do not prevent accidental scalding or burning of curious individuals who might be tempted to touch it while it is in operation. Furthermore, the prior design has not taken into full account the exceedingly high temperatures in the incinerator which can cause buckling or warping of its walls and the advisability of making the portable incinerator large enough for industrial applications.

SUMMARY OF THE INVENTION

Accordingly it is an object of the present invention to provide an incinerator which can be easily towed from place to place by a vehicle, for example a pickup truck.

It is another object of the present invention to provide a portable incinerator of the above type with internal side walls which are capable of expanding and contracting with the heating and cooling in the incinerator without transmitting the expansion or contracting to outer walls of the incinerator.

It is still a further object of the present invention to provide an outer protective covering on the portable incinerator to reduce the possibility of accidental scalding of curious onlookers who might touch the incinerator during operation.

In accordance with a novel and unique arrangement for a portable incinerator system which meets the foregoing and many other objects, a rectangular housing is supported on a wheel assembly which permits the incinerator to be towed by medium-sized vehicles, for example a pick-up truck, over common roads and highways.

the rear section of the housing defines a main firing chamber containing several grates and an ash pit under the grates. Refuse is introduced through hopper doors located at the rear of the housing. Upon being burned in the main firing chamber the refuse is converted into ash which is then removed from the ash pit. The front of the housing defines a secondary reduction chamber wherein the emissions emanating from the main firing chamber are constrained to follow a circuitous path. The circuitous path takes the emissions first through an after burner section wherein the emissions are burned again by a secondary burner which burns at a higher temperature and thereafter through a wet-scrubbing section wherein particulate and other harmful material contained in the emissions is further reduced.

A tow bar disposed along the front or the rear of the housing is specifically adapted to permit easy connection of the towable incinerator to a vehicle. A leveling chuck at or near the tow bar permits the housing to remain level while it is disconnected from the vehicle.

Furthermore, the interior of the main firing chamber is lined with interior walls comprised of several wall sections which slightly overlap one another in a manner that is effective for enabling relative sliding along the overlapped sections. This prevents buckling or warping of the wall sections that otherwise might ensue on account of the extreme temperature cycling within the incinerator. Heat insulation is disposed between the interior walls and the outer walls of the housing. Since the outer walls can still become quite hot, a protective covering, preferably in the form of a screen or a mesh, is spacedly located on the outer wall.

Water for the wet-scrubbing section and natural gas or propane for the burners in the main firing chamber or for the after burner are contained in tanks that are disposed along appropriate ledges formed along one section of the housing on the exterior thereof. The portable incinerator may also be equipped with direct connection ports to external sources for water, propane, or natural gas which sources may optionally be located in tanks located on a truck or similar vehicle that will be used for towing the portable incinerator.

Other features and advantages of the present invention will become apparent from a following description of preferred embodiment of the invention, which refers to the following drawings.

DETAILED DESCRIPTION OF THE DRAWINGS

Figure 1:
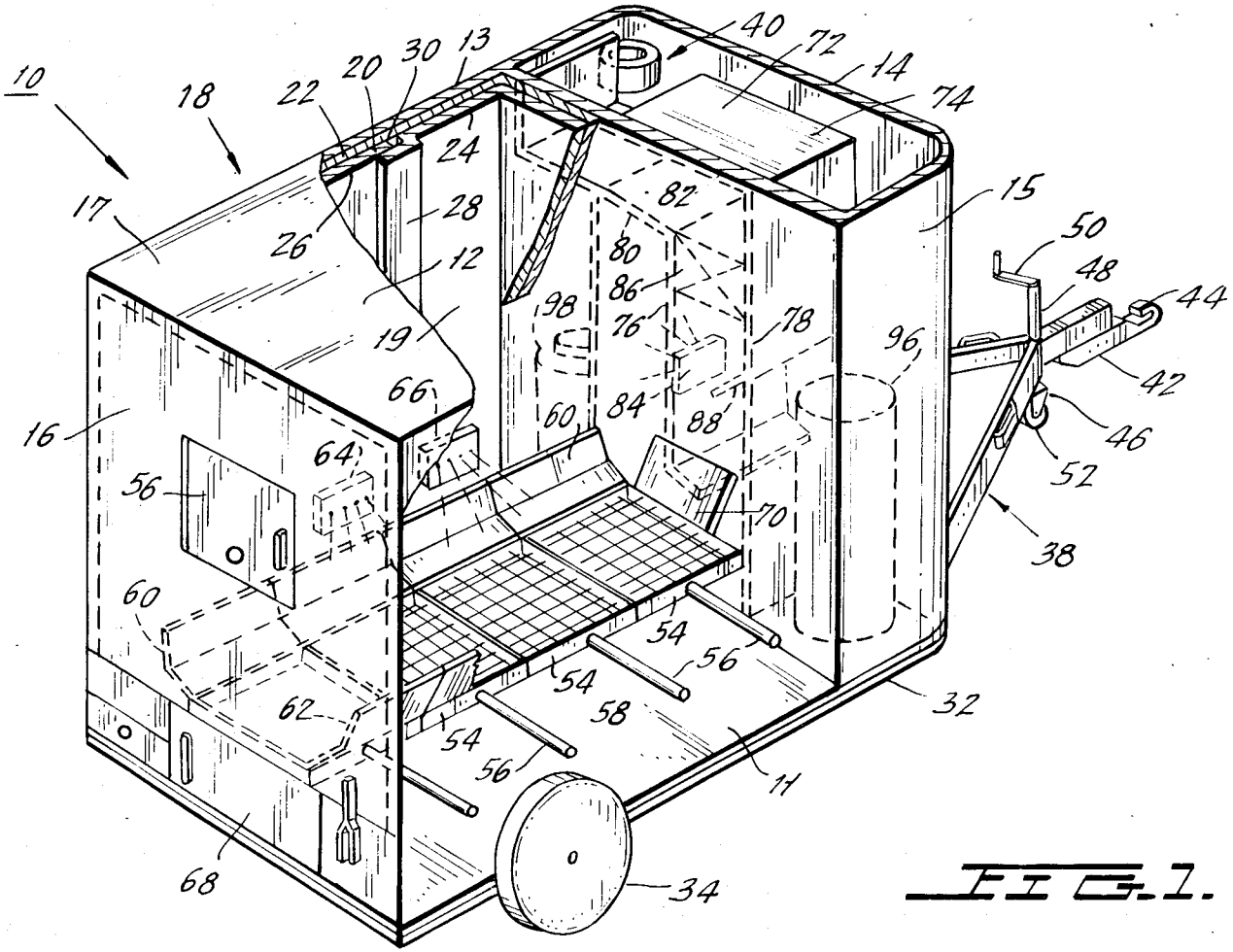
FIG. 1 provides a perspective view, partially cut away, of the towable incinerator of the present invention.

FIG. 1 perspectively shows a towable incinerator 10 which is designed in accordance with the concepts of the present invention. The remaining FIGS. provide sectional views of the apparatus of FIG. 1, and are helpful in explaining the various features of the incinerator 10.

Referring to FIG. 1, the portable incinerator 10 comprises a generally rectangular housing measuring about 6'×8'×8' having a floor 11, a ceiling 12 and four side walls designated respectively 13, 14, 15 and 16 which together cooperate to form a metallic outer encloser 17. Metallic outer enclosure 17 defines along a rear region 18 thereof a firing chamber 19 which is surrounded by an interior wall 20 made of fire resistant materials. A fireproof insulation material 22, for example asbestos, is disposed between interior wall 20 and outer enclosure 17.

Free ends 28 and 30 of interior wall sections 24 and 26 overlap one another in a manner that allows the free ends to slide over one another in response to the extreme temperature cycles within firing chamber 19. The foregoing features provide better heat insulation capability and further assure that expansion and contraction due to heat variation is absorbed in the interior enclosure so as to protect the outer enclosure from warping or buckling.

Figure 3:
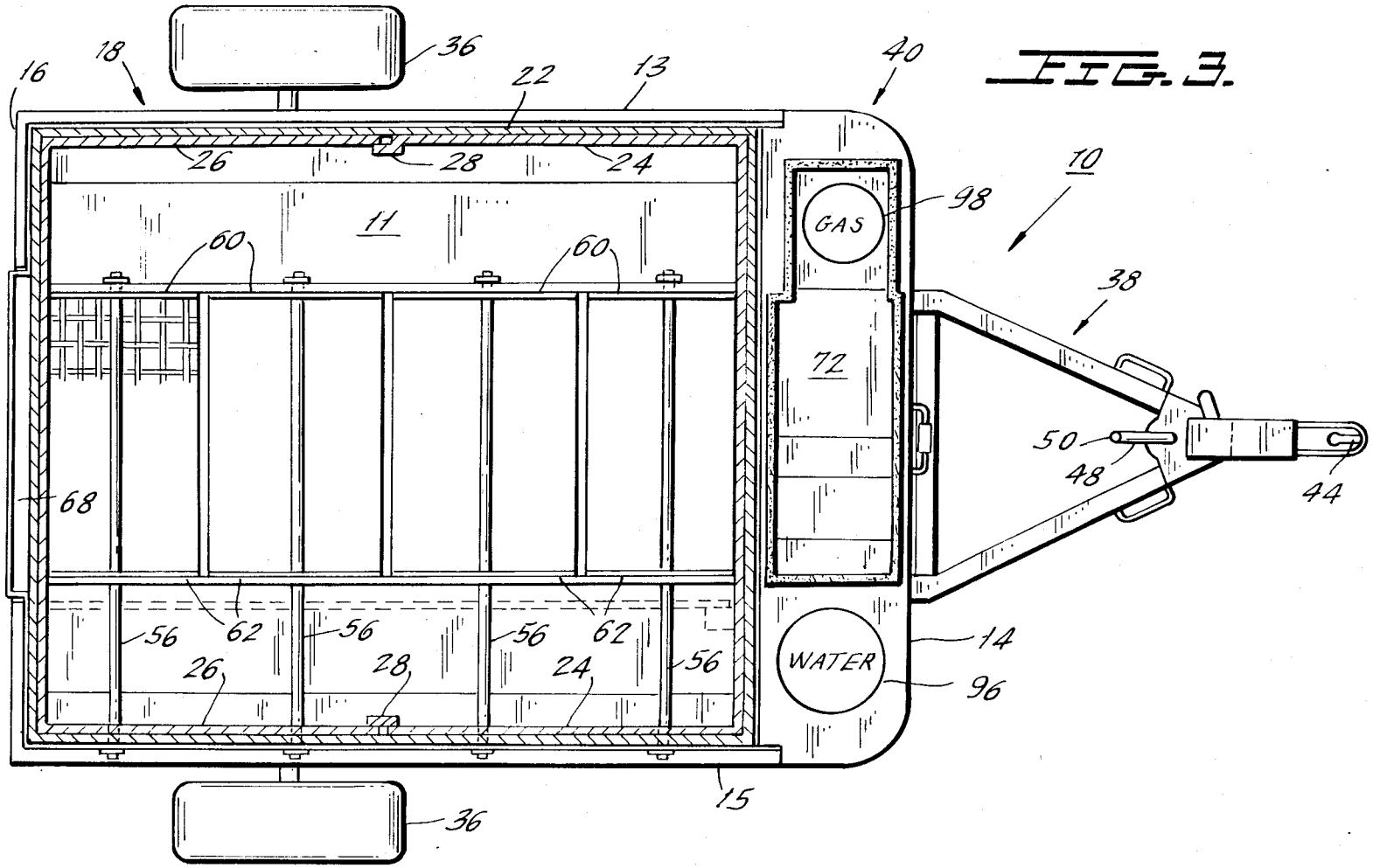
FIG. 3 provides a top view cross-section through the incinerator.

Metal enclosure 17 is supported on base frame 32 which is in turn located on a wheel assembly 34 which is designed for supporting substantially the entire weight of incinerator 10 thereon. Wheels 36 (FIG. 3) of wheel assembly 34 may be of rubber and adapted to allow incinerator 10 to be transported smoothly and at highway speeds by means of a towing vehicle (not shown) which most suitably may be a pickup or similar light truck.

For towing purposes, substantially V-shaped tow bar 38 extends along a front region 40 of incinerator 10 and includes a connection bracket 42 of the known type which may include a coupler 44 for coupling incinerator 10 to the rear of the vehicle. A foot member 46 disposed near coupler 44 consists of a vertically disposed rod 48 threadedly received in the V-shaped rigid towing bar 38 and handle 50 connected to vertical rod 48 permits the rod to be rotated for adjusting the height of the towing bar above ground and/or for leveling housing 17 where incinerator 10 is not connected to a vehicle. A roller or caster 52 may be connected near the bottom of rod 48 to provide local movability.

A plurality of generally flat and horizontally extending grates 54 extend above floor 11 in firing chamber 19 and serve to support refuse which may be introduced into firing chamber 19 through hopper doors 56 located on rear wall 16 of metal enclosure or housing 17. Each of the grates is tiltable about one of pivot rods 56 into a vertical orientation that allows decomposed refuse to fall into ash pit 58 defined underneath metal grates 54. Pivoting rods 56 may be connected to suitable crank handles (not shown) which are accessible outside incinerator 10 to enable metal grates 54 to be rotated to their vertical orientation. Refuse retaining members 60 and 62, disposed along the sides of metal grates 54, define a trough which concentrates the refuse on metal grates 54 for optimal burning by suitable burners such as burners 64 and 66 located in firing chamber 19. Burners 64 and 66 emit a hot flame, for example about 800° C., which consumes the refuse, converting most of it to ash which drops into ash pit 58. The ash collected in ash pit 58 may be withdrawn periodically by opening cleaning door 68 located on rear wall 16 and underneath hopper door 56.

The gaseous emissions and fumes from the burning process are constrained to exit firing chamber 19 through opening 70 located at the bottom of firing chamber 19 to enter a secondary reductio apparatus 72 located along front region 40 of metal enclosure 17.

Secondary reduction apparatus 72 includes conduit 74 defined by walls 76, 78, 80 and 82 in which are housed first along a bottom region an after burner 84 and further upstream a wet-scrubbing section 86, for example of the type described in the present Applicant's U.S. Pat. No. 3,728,976.

Obliquely arranged ledge 88 directs the fumes adjacent after burner 84 which burns at a temperature about twice as hot as the temperature of burners 64 and 66 of main firing chamber 19. This reduces and burns particulate content remaining in the fumes that exit from main firing chamber 19.

Figure 2:
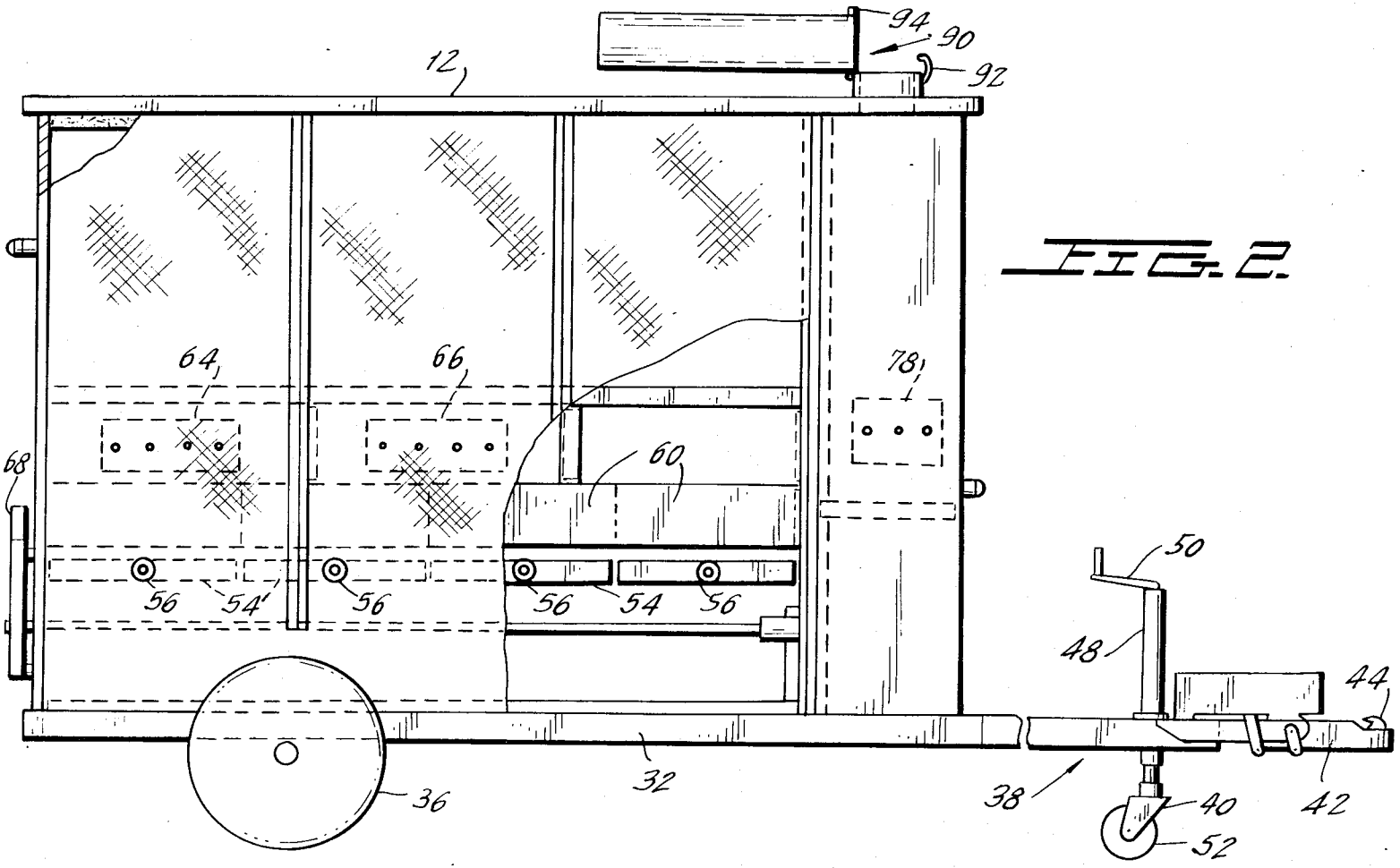
FIG. 2 is a vertical cross-section through the incinerator of FIG. 1.

In wet-scrubbing section 86, a water spray is directed at a barrier plate through which the fumes flow washing ash-like content out of the fumes and transforming the fumes into a sufficiently "clean" state that may be safely and legally evacuated into the atmosphere through smokestack 90 (FIG. 2).

Smokestack 90, about 30 inches in height, has a foldable design that allows it to fold over ceiling 12 of housing 17. A latching mechanism consisting of latch 92 and tab 94 supports smokestack 90 in an upright position.

Propane or natural gas for main burners 64 and 66, and for after burner 84, are stored in gas tank 96 which is located on ledge 98 (FIG. 3) formed on base frame 32 outside housing 17. Oppositely, along front region 40, is located water tank 98 having a capacity of about 30 gallons, that is operatively connected to wet-scrubbing section 86.

Figure 4:
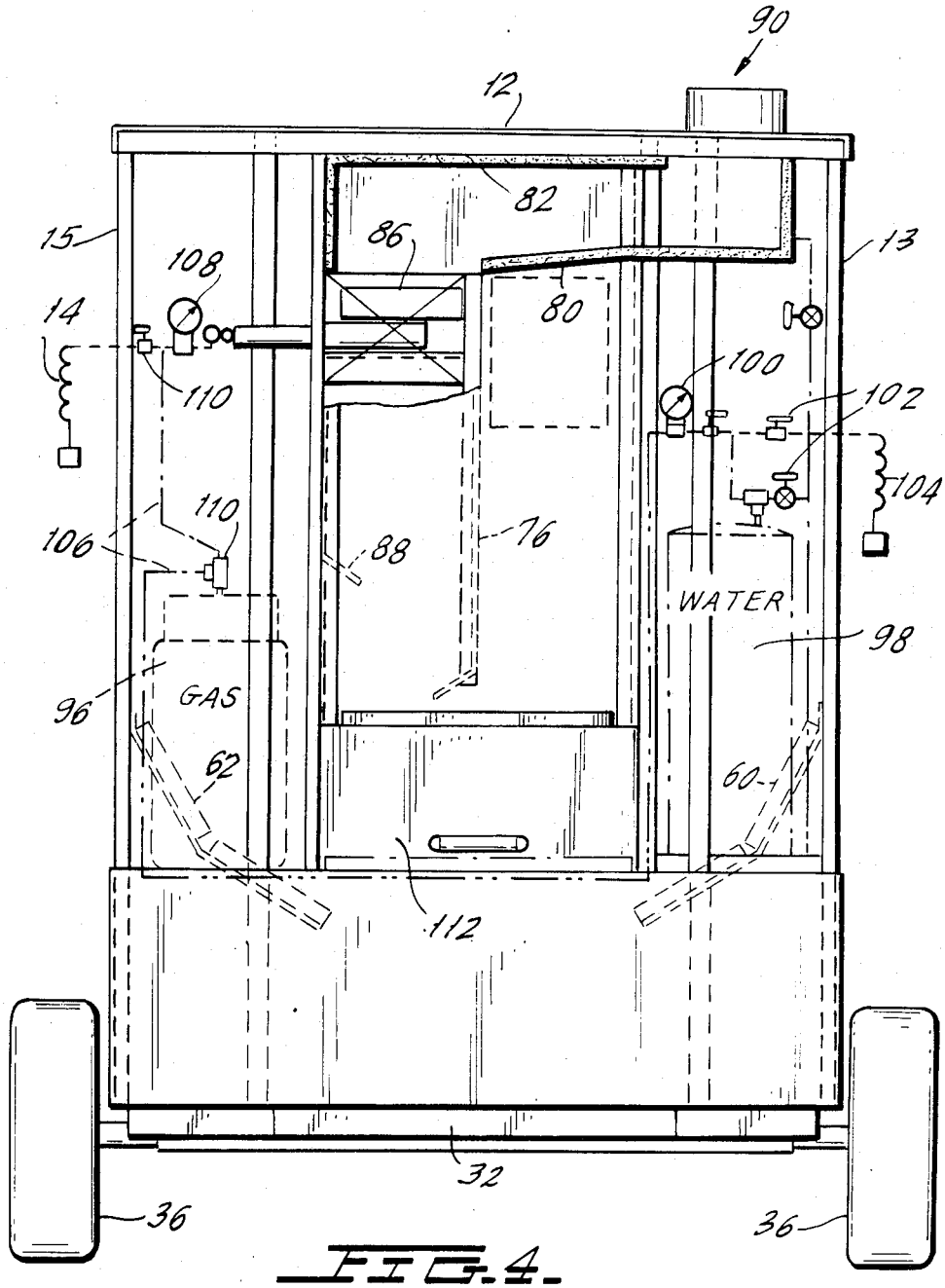
FIG. 4 is an elevational cross-section through a front region of the incinerator housing.
Figure 5:
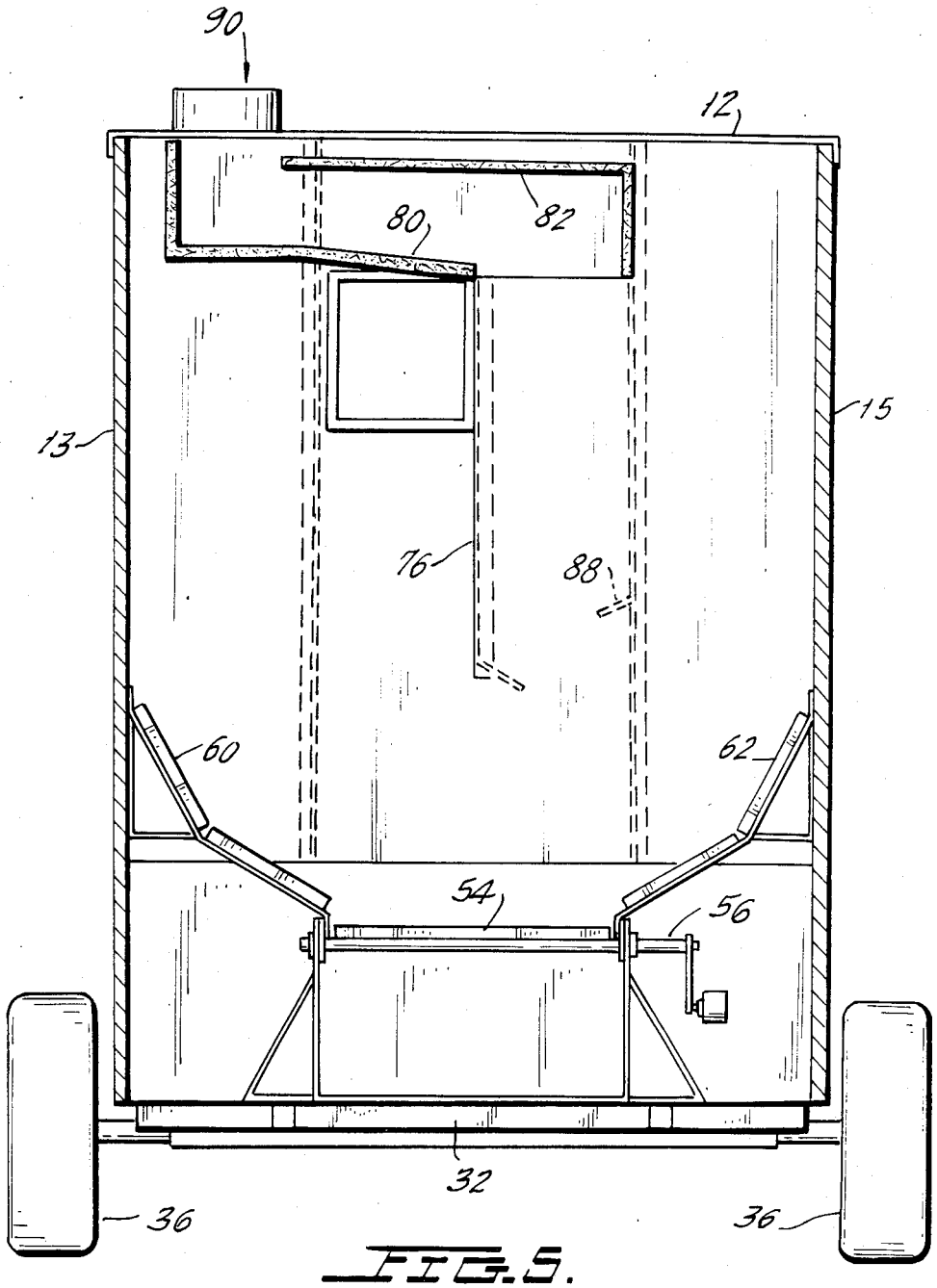
FIG. 5 is an elevational cross-section through a rear region of the incinerator housing.

FIG. 4 illustrates the various hoses that direct water from water tank 98 to wet-scrubbing section 86 including gauges 10, valves 102 and the like. Hose extension 104 enables incinerator 10 to be connected to an external water supply source that can be conveniently located on the same truck that is used for towing incinerator 10. Similarly, the fuel supply includes fuel hoses 106 regulators 108 and various valves 110 for regulating the flow of fuel to the burners within incinerator 10. Access door 112 provides to the internal structure as needed for repairing or inspecting after burner 84 and wet-scrubber 86.

Fuel extension hose 114 provides that capability of connecting an external fuel supply, that can be located on the vehicle. In this manner the incinerator can have a fuel capacity that can last over a relatively longer period. A small tank of low-pressure gas is connected at the bottom of the water tank 98 to pressurize the water to a pressure needed for producing a fine spray in the wet-scrubbing section 86.

As described above, a towable incinerator system is provided based on the novel waste disposal concept that provides a self-contained and easily towable incinerator that can be moved from location to location. Refuse is conveniently introduced through the hopper door into the incinerator and can be burned while on route to another location.

Although the invention has been described in relation to a specific embodiment thereof, many other variations and modifications will now become apparent to those skilled in the art. It is preferred, therefore, that the present invention be limited not by the specific disclosure herein, but only by the appended claims.

What is claimed is:

1. An incinerator towable by a vehicle for burning refuse, comprising:

a metallic housing and a horizontally extending base frame for supporting the housing thereon, the housing including outer walls and defining a rear region and a front region within;

a wheel assembly coupled to the base frame and so disposed with respect thereto to support substantially the entire weight of the housing thereon and further being effective for enabling the incinerator to be transportable at highway speeds;

towing means for enabling the incinerator to be connected to and be towed by the vehicle from location to location;

a main firing chamber hopper door means for defining an opening into the firing chamber through which refuse may be introduced thereinto, means for burning refuse in the firing chamber, burnt refuse collection means disposed along a bottom region in the firing chamber, interior walls located in the firing chamber, the interior walls including a plurality of wall sections which partially overlap one another in a manner which allows the interior walls to slide over one another back and forth in a general direction which extends from the rear region to the front region so that the exterior walls expand and contract without warping in response to temperature cycles in the firing chamber, and heat shielding means disposed between the interior walls and the metallic housing; and secondary reduction means disposed in the front region of the housing, the secondary reduction means including a conduit defining a circuitous path and having an inlet adapted to receive emissions from said firing chamber and an outlet at the top of said conduit, after burning means disposed in the conduit for reburning the emissions, and wet-scrubbing means disposed upstream of the after burning means and effective for removing particulate matter from the emissions.

2. The incinerator of claim 1, further comprising ledge means formed on the base frame outside the housing and tank means located on the ledge for supplying fuel to the refuse burning means and to the after burner means.

3. The incinerator of claim 2, in which the tank means further comprises a water tank for supplying water to the wet-scrubbing means.

4. The incinerator of claim 1, further comprising auxiliary fuel and water connection means for enabling the incinerator to be connected to external sources of water and fuel which sources are located off the incinerator.

5. The incinerator of claim 1, further comprising chuck means disposed adjacent of the towing means, the chuck means being effective for maintaining the housing at a horizontally level orientation when the incinerator is not connected to the towing vehicle.

6. The incinerator of claim 1, which further comprises means for preventing accidental touching of the metallic housing.

7. The incinerator of claim 6, in which the preventing means comprises a wire mesh disposed along the exterior of the metallic housing at a predetermined distance therefrom.

8. The incinerator of claim 1, which further comprises a stack located atop the secondary reduction means and in communication with the outlet from the conduit.

9. The incinerator of claim 8, in which the stack is foldable to a position wherein it extends over the housing and in parallel to the base frame.

10. The incinerator of claim 3, which further comprises water pressurization means connected to the water tank for maintaining water in said tank at at least a minimum predetermined pressure.

11. The incinerator of claim 1, in which the heat shielding means comprises asbestos disposed between the interior walls and the metallic housing.

12. The incinerator of claim 1, in which the secondary reduction means are spaced away from the metallic housing to reduce conduction of heat to the metallic housing.

13. An incinerator towable by a vehicle for burning refuse, comprising:

a metallic housing and a horizontally extending base frame for supporting the housing thereon, the housing including outer walls and defining a rear region and a front region within;

a wheel assembly coupled to the base frame and so disposed with respect thereto to support substantially the entire weight of the housing thereon and further being effective for enabling the incinerator to be transportable at highway speeds;

towing means for enabling the incinerator to be connected to and be towed by the vehicle from location to location;

a main firing chamber hopper door means for defining an opening into the firing chamber through which refuse may be introduced thereinto, means for burning refuse in the firing chamber, burnt refuse collection means disposed along a bottom region in the firing chamber, interior walls located in the firing chamber, the interior walls including a plurality of wall sections which partially overlap one another in a manner which allows the interior walls to expand and contract without warping in response to temperature cycles in the firing chamber, and heat shielding means disposed between the interior walls and the metallic housing;

secondary reduction means disposed in the front region of the housing, the secondary reduction means including a conduit defining a circuitous path and having an inlet adapted to receive emissions from said firing chamber and an outlet at the top of said conduit, after burning means disposed in the conduit for reburning the emissions, and wet-scrubbing means disposed upstream of the after burning means and effective for removing particulate matter from the emissions; and auxiliary fuel and water connection means for enabling the incinerator to be connected to external sources of water and fuel which sources are located off the incinerator.

14. An incinerator towable by a vehicle for burning refuse, comprising:

a metallic housing and a horizontally extending base frame for supporting the housing thereon, the housing including outer walls and defining a rear region and a front region within;

a wheel assembly coupled to the base frame and so disposed with respect thereto to support substantially the entire weight of the housing thereon and further being effective for enabling the incinerator to be transportable at highway speeds;

towing means for enabling the incinerator to be connected to and be towed by the vehicle from location to location;

a main firing chamber hopper door means for defining an opening into the firing chamber through which refuse may be introduced thereinto, means for burning refuse in the firing chamber, burnt refuse collection means disposed along a bottom region in the firing chamber, interior walls located in the firing chamber, the interior walls including a plurality of wall sections which partially overlap one another in a manner which allows the interior walls to expand and contract without warping in response to temperature cycles in the firing chamber, and heat shielding means disposed between the interior walls and the metallic housing;

secondary reduction means disposed in the front region of the housing, the secondary reduction means including a conduit defining a circuitous path and having an inlet adapted to receive emissions from said firing chamber and an outlet at the top of said conduit, after burning means disposed in the conduit for reburning the emissions, and wet-scrubbing means disposed upstream of the after burning means and effective for removing particulate matter from the emissions; and further comprising means for preventing accidental touching of the metallic housing, the preventing means including a wire mesh disposed along the exterior of the metallic housing at a predetermined distance therefrom.

15. An incinerator towable by a vehicle for burning refuse, comprising:

a metallic housing and a horizontally extending base frame for supporting the housing thereon, the housing including outer walls and defining a rear region and a front region within;

a wheel assembly coupled to the base frame and so disposed with respect thereto to support substantially the entire weight of the housing thereon and further being effective for enabling the incinerator to be transportable at highway speeds;

towing means for enabling the incinerator to be connected to and be towed by the vehicle from location to location;

a main firing chamber hopper door means for defining an opening into the firing chamber through which refuse may be introduced thereinto, means for burning refuse in the firing chamber, burst refuse collection means disposed along a bottom region in the firing chamber, interior walls located in the firing chamber, the interior walls including a plurality of wall sections which partially overlap one another in a manner which allows the interior walls to expand and contract without warping in response to temperature cycles in the firing chamber, and heat shielding means disposed between the interior walls and the metallic housing;

secondary reduction means disposed in the front region of the housing, the secondary reduction means including a conduit defining a circuitous path and having an inlet adapted to receive emissions from said firing chamber and an outlet at the top of said conduit, after burning means disposed in the conduit for reburning the emissions, and wet-scrubbing means disposed upstream of the after burning means and effective for removing particulate matter from the emissions; and a stack located atop the secondary reduction means and in communication with the outlet from the conduit, the stack being foldable to a position wherein it extends over the housing and in parallel to the base frame.

* * * * *